United States Patent [19]

Grandi

[11] 4,224,009

[45] Sep. 23, 1980

[54] SUBMERSIBLE PUMP WITH IMPROVED SEALING MEANS

[75] Inventor: Attilio Grandi, La Spezia, Italy

[73] Assignee: Termomeccanica Italiana S.p.A., La Spezia, Italy

[21] Appl. No.: 884,801

[22] Filed: Mar. 9, 1978

[30] Foreign Application Priority Data

Mar. 21, 1977 [IT] Italy ..... 12520 A/77

[51] Int. Cl.[3] ..... F01D 11/00; F01D 15/08

[52] U.S. Cl. ..... 415/168; 415/169 A

[58] Field of Search ..... 415/169 A, 113, 121 A, 415/169 R, 168, 110, 111, 112

[56] References Cited

U.S. PATENT DOCUMENTS

| | | | |
|---|---|---|---|
| 1,937,461 | 11/1933 | Mylting | 415/169 A X |
| 2,719,737 | 10/1955 | Fletcher | 415/113 X |
| 3,051,497 | 8/1962 | Wigg et al. | 415/169 A X |
| 3,281,062 | 10/1966 | Papapanu | 415/169 R |
| 3,558,238 | 1/1971 | Van Herpt | 415/169 A |
| 3,622,164 | 11/1971 | Herbert et al. | 415/169 A |
| 3,728,857 | 4/1973 | Nichols | 415/110 X |
| 3,746,350 | 7/1973 | Mayer et al. | 415/169 A X |

FOREIGN PATENT DOCUMENTS

| | | | |
|---|---|---|---|
| 501574 | 3/1951 | Belgium | 415/169 A |
| 557753 | 2/1957 | Italy | 415/169 A |
| 44-16618 | 7/1969 | Japan | 415/113 |

*Primary Examiner*—Everette A. Powell, Jr.

*Attorney, Agent, or Firm*—Robert E. Burns; Emmanuel J. Lobato; Bruce L. Adams

[57] ABSTRACT

A submersible pump provided with improved labyrinth to avoid undesirable leakage of a pump fluid into the hydraulic motor of the pump and to avoid leakage of hydraulic motor into the pump.

1 Claim, 1 Drawing Figure

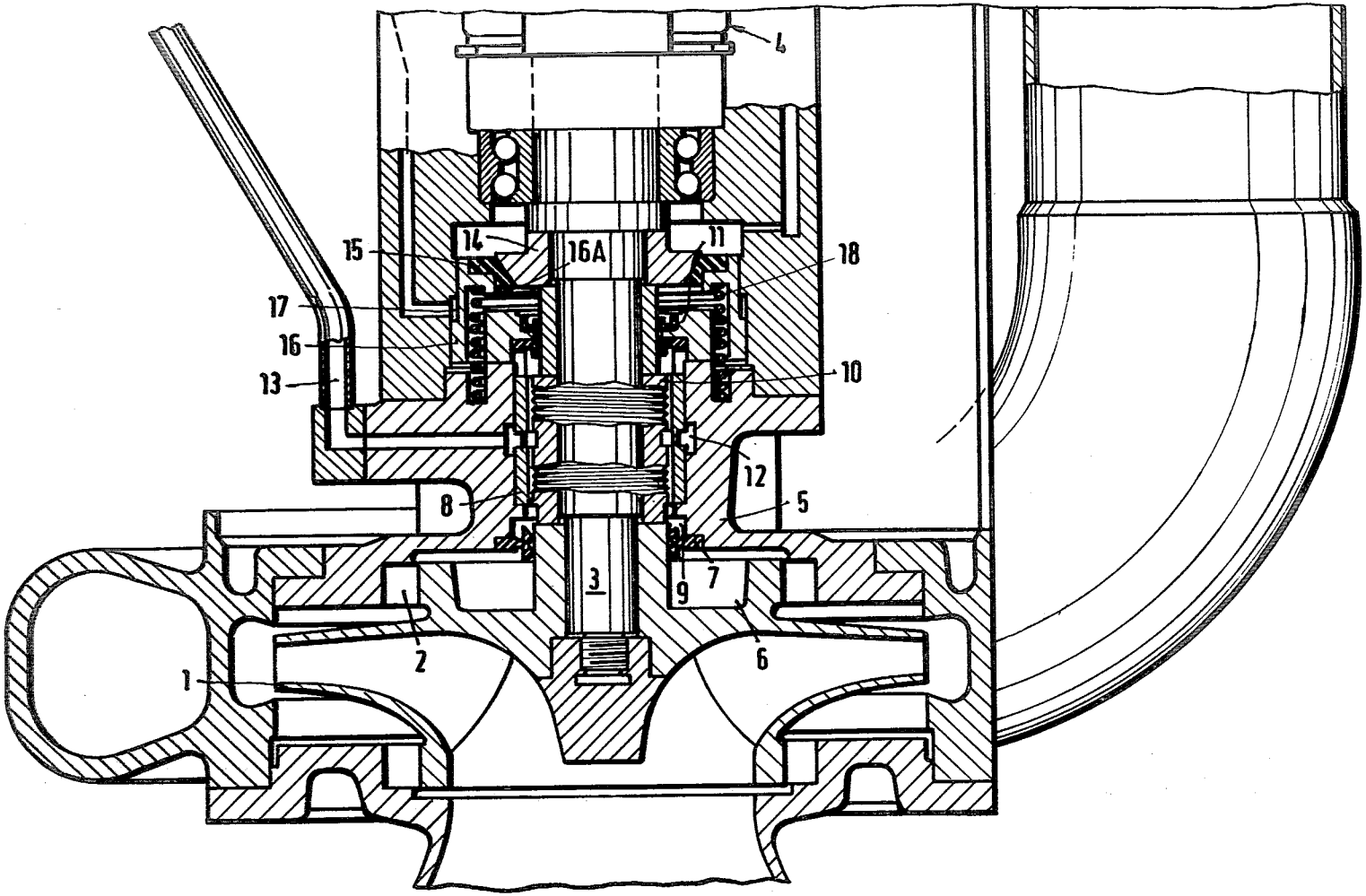
1
2
3
4
5
6
7
8
9
10
11
12
13
14
15
16
16A
17
18

SUBMERSIBLE PUMP WITH IMPROVED SEALING MEANS

BACKGROUND OF THE INVENTION

The invention relates to submersible pumps actuated particularly by hydraulic engines, wherein therefore it is necessary to control, besides the leaks of the pumped fluid, also those of the driving fluid and further the unavoidable mixing of the driving fluid with the pumped fluid in the above leaks.

It is known that the greatest danger in the operation of said pumps is that of a mixing of the pumped fluid with the driving fluid, either during the operation of the pump or during the rest periods thereof.

OBJECT OF THE INVENTION

In view of the foregoing, the invention aims at avoiding undesirable leaks of the pumped fluid.

SUMMARY OF THE INVENTION

A feature of the method suggested by the invention is that of conveying during the pump operation, individually or at the same time, the leaks occurring through the seals direct to a chamber and from there outwards without any help of air or gas under pressure, which could form dangerous mixtures with the moved liquids.

In accordance with the invention, a pump actuated hydraulically or in a like manner, is provided in a zone of the driving shaft with a seal system comprising two labyrinth pumps operating an opposite way and suitably sized, so as to convey the leaks of the driving fluid and the pumped liquids to a common chamber and from here outwards through a suitable conduit.

In addition to the system, a second seal is provided just above said zone, this seal starting operating only when the pump is not working and avoids any mixing between said two liquids.

Consequently, this zone of collection for the two liquids, the driving liquid and the pumped one, is constantly under pressure, and thanks to the pressure the mixture of the two liquids is conveyed to a suitable collecting container without any possibility that combustion gases could mix with the liquids, forming very dangerous vapors.

It is to be appreciated that this feature is the reverse completely to what is suggested by the present state of the art, according to which a partial vaccum is formed within the chamber for the two liquids mixing.

The reduced pressure tends to suck the liquids concerned, with unavoidable formation of gases and unavoidable filtration of the surrounding air sucked through the leaks of the conduits inside said chamber, or inside the conduits conveying the sucked mixture from said chamber to the collecting tank.

BRIEF DESCRIPTION OF THE DRAWINGS

In order that the invention may be clearly understood, it will now be described, by way of example, with reference to the accompanying drawings, wherein the single FIGURE shows an axial vertical section of the lower zone of the pump concerned.

DESCRIPTION OF A PREFERRED EMBODIMENT

The pump according to the invention is a conventional centrifugal pump sucking axially from its lower part, comprising an impeller 1 provided with wearing rings 2, a shaft 3 and an hydraulic engine 4.

Between said impeller 1 and a body 5, a chamber 6 is kept at the prevailing static pressure of the pumped liquid. A sealing ring 7 is arranged between the chamber and the upper portion of said shaft.

A zone defined by a bushing 8 is provided above, correspondingly to which rotate, driven by said shaft 3, two labyrinth pumps 9 and 10 whose function is to convey the leaks, which may occur correspondingly to said sealing ring 7 and an upper sealing ring 11, to an intermediate chamber 12 communicating with the surrounding air through a conduit 13.

A ring 14, rotating with said shaft; is arranged above said second sealing ring 11, a seal 15 integral with a mobile system 16, acts on said ring 14.

During the pump operation, the mobile system 16 is kept in its depressed position through a pressure fluid acting in the differential chamber 17. When on the contrary the pump is not working, owing to the absence of pressure within the differential chamber 17, the mobile system 16 is put in contact, through said seal 15, with said rotating ring 14 by means of the action of a spring 18. In such a way, when the pump is not working, the driving fluid is prevented from mixing to to the fluid to be pumped and vice versa.

In the drawings, the hydraulic engine 4 is shown only diagrammatically, being of known type.

The conduit 13 is provided with intercepting means, not shown in the drawings as being of known type, allowing communication to the outside of said intermediate collecting chamber 12 only when the pressure inside same reaches a pre-fixed level, and that in order to prevent the surrounding air from entering in any case said conduit 13 and thus said intermediate collecting chamber 12 with consequent formation of undesired explasive mixtures.

It is to be understood that the invention is not limited to the example shown. It is intended to cover all modifications and equivalents within the scope of the appended claims.

What we claim is:

1. In a vertical submersible pump, a hydraulic motor, a driven shaft driven by said motor, an impeller on said driven shaft, a first seal sealing circumferentially of said driven shaft to prevent leakage of hydraulic fluid along said shaft, a second seal to prevent leakage along said shaft of a fluid pumped by said impeller, means defining a collecting chamber circumferentially of said shaft intermediate said first seal and said second seal, means to prevent hydraulic fluid leakage into the pump and to prevent leakage of the liquid being pumped into the hydraulic motor comprising two labyrinth pumps about said driven shaft on opposite sides of said collecting chamber pumping hydraulic fluid leakage and the pumped fluid leakage respectively to said collecting chamber intermediate therebetween, said two labyrinth pumps comprising a first labyrinth pump continuously applying during rotation of said shaft a suction to said first seal to pump under pressure into said collecting chamber hydraulic fluid leakage past said first seal into said collecting chamber and a second labyrinth pump continuously applying a suction during rotation of said shaft to said second seal to pump under pressure into said collecting chamber leakage of the liquid being pumped past said second seal, and means to feed the leakage received in said collecting chamber externally of said pump.

* * * * *